US005573252A

United States Patent [19]

Simmons

[11] Patent Number: 5,573,252

[45] Date of Patent: Nov. 12, 1996

[54] TRAINING DEVICE

[76] Inventor: Gary M. Simmons, 60 Winchester Ct., Reading, Pa. 19606

[21] Appl. No.: 589,056

[22] Filed: Jan. 19, 1996

[51] Int. Cl.[6] ..... A63B 22/00

[52] U.S. Cl. ..... 273/454; 273/396; 273/445; 273/447

[58] Field of Search ..... 273/447, 445, 273/446, 396, 394, 1.5 A, 440, 454

[56] References Cited

U.S. PATENT DOCUMENTS

| | | | |
|---|---|---|---|
| 1,269,184 | 6/1918 | Howley | 273/445 |
| 1,771,466 | 7/1930 | Scanlon | 273/396 X |
| 2,060,938 | 11/1936 | Johnson | 272/57 |
| 2,454,478 | 11/1948 | Roberts | 273/445 X |
| 3,069,805 | 12/1962 | Burrows | 46/16 |
| 3,322,426 | 5/1967 | Zulkoski | 273/396 |
| 3,406,971 | 10/1968 | Koff | 273/109 |
| 3,696,549 | 10/1972 | Zillus | 46/43 |
| 3,913,916 | 10/1975 | Martin, Jr. | 273/396 |
| 5,246,225 | 9/1993 | Matherne et al. | 273/1.5 A |
| 5,499,821 | 3/1996 | Rycroft | 273/394 X |

FOREIGN PATENT DOCUMENTS

| | | | |
|---|---|---|---|
| 1364290 | 8/1974 | United Kingdom | 273/396 |

*Primary Examiner*—Paul E. Shapiro
*Attorney, Agent, or Firm*—Norman E. Lehrer; Jeffrey S. Ginsberg

[57] ABSTRACT

A training device for developing hand-eye coordination in a child. The device includes a housing with front and rear walls, two side walls, an open top end and a bottom end. The housing also has a plurality of openings formed in the front wall of the housing adjacent the bottom end thereof. A plurality of tubes with upper and lower ends are secured in the housing. The lower end of each of the tubes is connected to one of the openings formed in the front wall of the housing. Secured to the top end of the housing is a hollow four walled removable insert. The insert serves to direct an object toward the open top end of the housing so that the object can randomly enter and pass through one of the tubes and out an associated opening in the front wall of the housing.

10 Claims, 2 Drawing Sheets

TRAINING DEVICE

BACKGROUND OF THE INVENTION

The present invention is directed toward a training device for children and, more particularly, to such a device for teaching children hand-eye coordination.

Amusement devices are known which utilize a number of passageways situated in a housing through which a ball may travel. In such devices, a ball is typically dropped through an opening in the housing and into one end of a passageway. The ball travels through the passageway and comes out the opposite end thereof. Examples of such amusement games are disclosed in U.S. Pat. Nos. 3,069,805, 3,406,971 and 3,696,549. None of the devices disclosed in these patents could be used to develop a child's hand-eye coordination beyond a minimal level. This is because the child can see which passageway the ball is going to travel through and, therefore, can readily ascertain the opening from which the ball will exit.

U.S. Pat. No. 2,060,938 discloses an exercising device that includes a generally rectangular chute-like cabinet that has an open top end and an opening adjacent the base thereof. The cabinet includes a deflecting means positioned near the opening in the base. In use, a ball dropped through the open top end falls through the chute-like cabinet. The ball then encounters the deflecting means which causes the ball to be rapidly propelled from the opening in the cabinet. Such a device would not be useful in trying to increase a small child's hand-eye coordination since the deflecting means causes the ball to be projected outwardly from the cabinet at a rate that is far too fast for a small child to be expected to react.

SUMMARY OF THE INVENTION

The present invention is designed to overcome the deficiencies of the prior art discussed above. It is an object of the present invention to provide a training device which is designed to increase a child's hand-eye coordination.

It is another object of the invention to provide such a training device which can measure improvements in a child's skill level.

It is another object of the invention to provide such a training device which can be utilized by two or more children at the same time.

In accordance with the illustrative embodiments, demonstrating features and advantages of the present invention, there is provided a training device for developing a child's motor skills. The device includes a housing with front and rear walls, two side walls, an open top end and a bottom end. The housing further has a plurality of openings formed in the front wall adjacent the bottom end thereof. A plurality of tubes are secured in the housing. Each of the tubes has upper and lower ends. The lower end of each of the tubes is associated with one of the openings formed in the front wall of the housing. Secured to the top end of the housing is a hollow four walled removable insert. The insert serves to direct an object toward the open top end of the housing so that the object can randomly enter and pass through one of the tubes and out an associated opening in the front wall of the housing.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
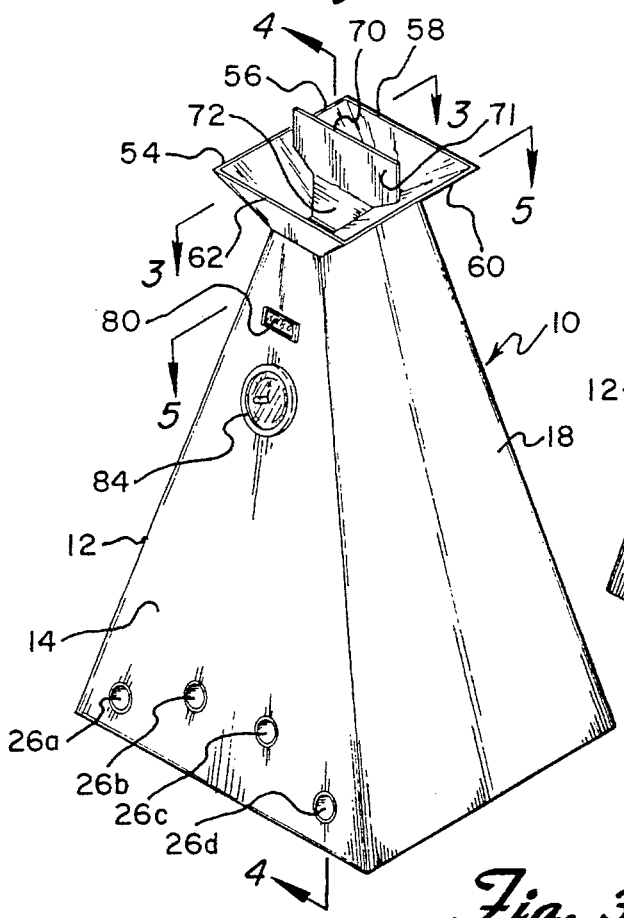
FIG. 1 is a front perspective view of the present invention.

Referring now to the drawings in detail wherein like reference numerals have been used throughout the various figures to designate like elements, there is shown in the figures a training device for developing a child's hand-eye coordination constructed in accordance with the principles of the present invention and designated generally as 10.

Figure 2:
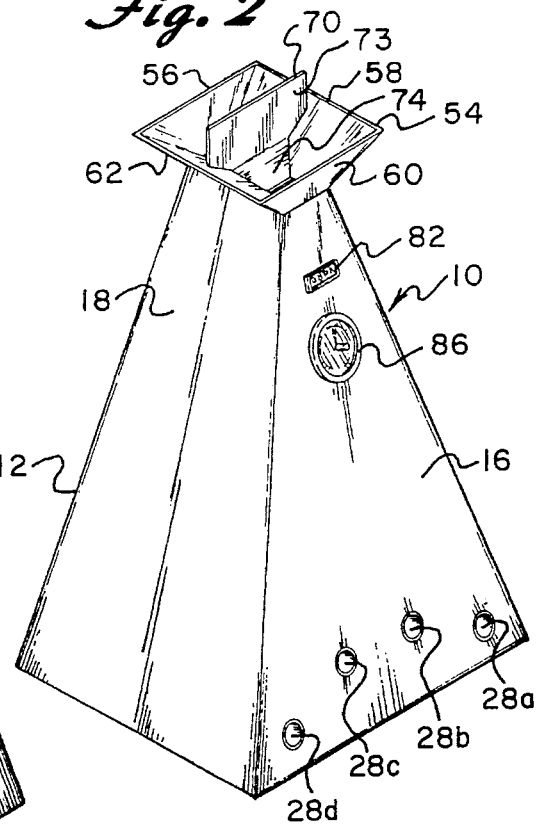
FIG. 2 is a rear perspective view of the present invention.
Figure 3:
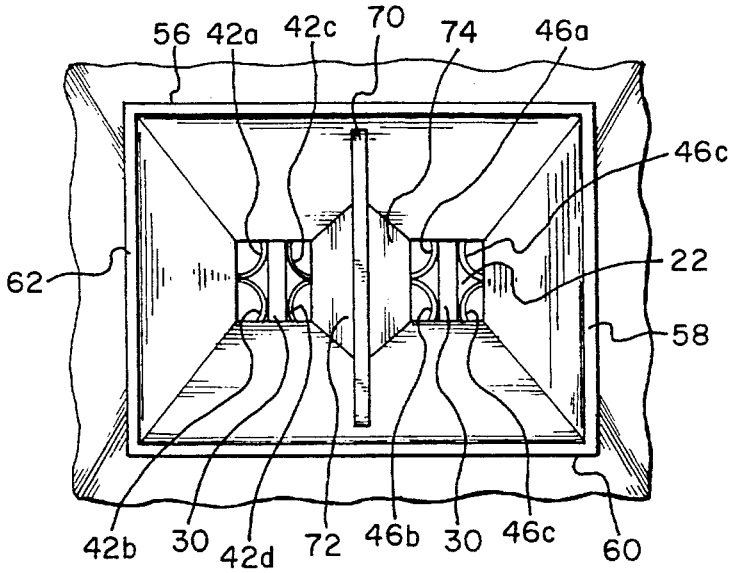
FIG. 3 is a top plan view taken along lines 3—3 of FIG. 1.

The training device 10 includes a housing 12 that has a front wall 14, a rear wall 16, two side walls 18 and 20, an open top end 22 and a bottom end 24. The housing 12 further has a plurality of openings 26*a–d* formed through the front wall 14 adjacent the bottom end 24 thereof (FIG. 1). Similarly, there are a plurality of openings 28*a–d* formed through the rear wall 16 (FIG. 2). The housing is preferably about three feet high.

In the preferred embodiment, a support member 30 is secured below the top end 22 of the housing 12 between the four walls thereof. The support member 30 has four rectangular openings 32, 34, 36 and 38 formed therethrough.

A plurality of front tubes 42*a–d* are secured in the housing 12. Each of the tubes is substantially the same as the other tubes. Accordingly, only one tube will be described in detail, it being understood that the description applies equally to the other tubes. Tube 42*d* includes an upper end 44 and a lower end 45. The lower end 45 of the tube 42*d* is secured to the periphery of opening 26*d* in the front wall 14 of the housing 12. Similarly, each of the other tubes 42*a–c* is secured to the periphery of an associated opening 42*a–c* in the front wall of the housing 12.

A plurality of rear tubes 46*a–d* are also secured in the housing 12. Each of the tubes 46*a–d* includes an upper end 48 and a lower end 50. The lower end 50 of each of the tubes 46 is secured to the periphery of a corresponding one of the openings 28*a–d* in the rear wall 16 of the housing 12. It should be noted that the number of tubes and associated openings can be increased or decreased.

Figure 5:
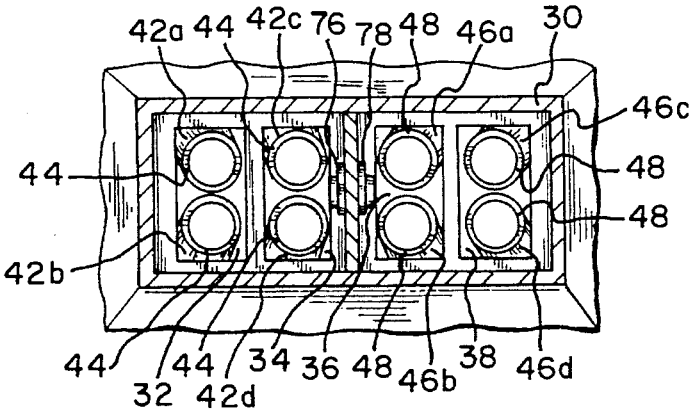
FIG. 5 is a cross-sectional view taken along lines 5—5 of FIG. 1.

Referring to FIG. 5, the upper ends of the tubes 42*a* and 42*b* are secured in rectangular opening 32 and the upper ends of tubes 42*c* and 42*d* are secured in the rectangular opening 34 in the support member. Similarly, the upper ends of tubes 46*a* and 46*b* are secured in the rectangular opening 36 and the upper ends of tubes 46*c* and 46*d* are secured in the rectangular opening 38 of the support member. The tubes are positioned so that there is only a small amount of space between adjacent tubes and the support member 30. Additionally, the tubes are sized to allow an object 52 of a predetermined size to pass therethrough as more fully described below. The tubes are preferably made of silicone rubber and have ribs formed around the inside periphery thereof to slow the object 52 that passes therethrough.

A removable insert 54 is secured to the top end 22 of the housing 12. The insert has four walls 56, 58, 60 and 62, an open top end 64 and open bottom end 66 as illustrated in FIGS. 1–4. In the preferred embodiment, each wall of the insert 54 converges inwardly from the top end 64 toward the bottom end 66 thereof. The bottom end 66 of the insert 54 is preferably friction fitted to the housing 12 adjacent the open top end 22 thereof.

Figure 4:
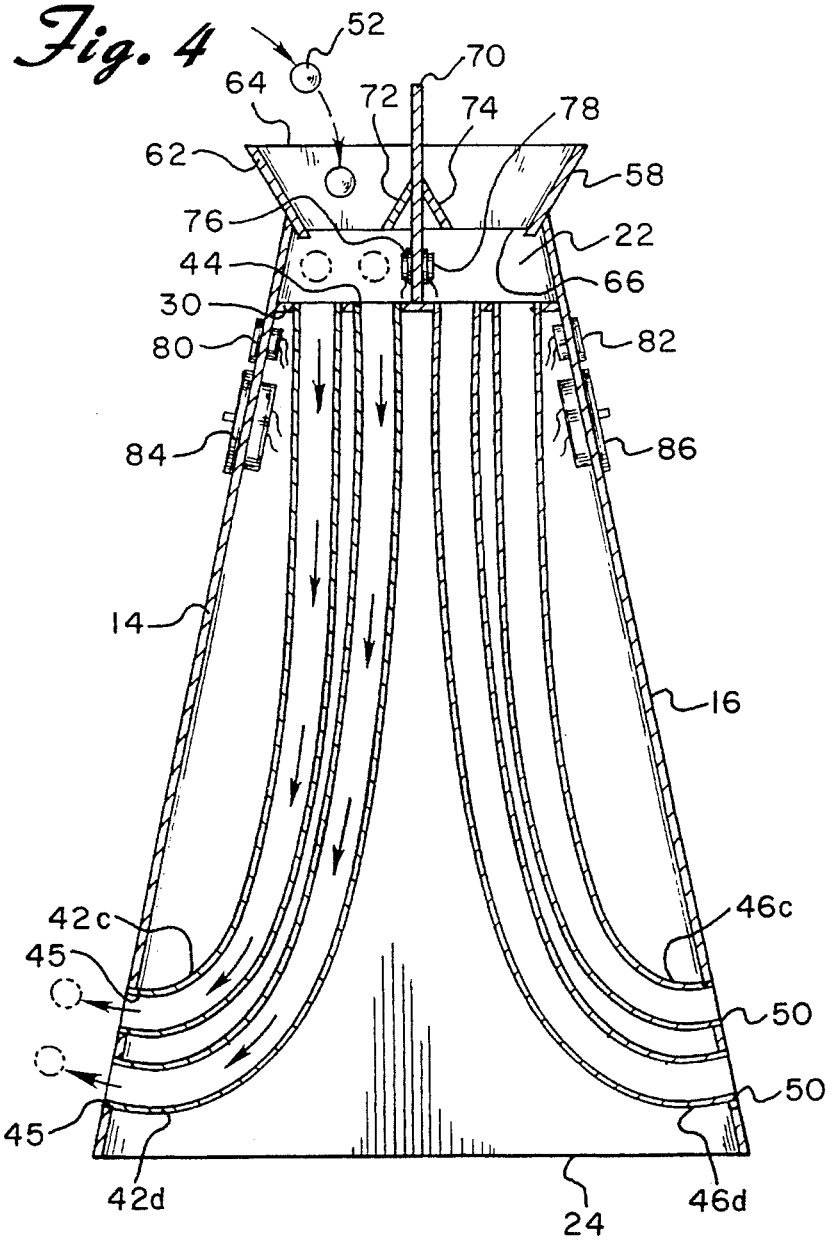
FIG. 4 is a cross-sectional view taken along lines 4—4 of FIG. 1.

A dividing member 70 with front and rear surfaces 71 and 73, respectively, is preferably secured between the center of the walls 58 and 62 of the insert 54. The bottom of the dividing member 70 is secured to the support member 30. Guide walls 72 and 74 converge inwardly from opposite sides of the dividing member 70 (FIG. 4).

In order to facilitate an understanding of the principles associated with the foregoing apparatus, its operation will now be briefly described. A child, who is positioned adjacent the front wall 14, takes a ball 52 and drops it through the open top end 64 of the insert. Specifically, the ball is dropped between the walls 56, 58 and 62 of the insert 54 and the front surface 71 of the dividing member 70 (FIG. 1). The inwardly converging walls 56, 58, and 62 of the insert 54 and the guide wall 72 serve to direct the ball through the open top end of the housing 22. Thereafter, the ball randomly enters and passes through one of the front tubes 42*a–d*. The tube into which the ball enters depends on a number of factors such as the force with which the ball hits the walls of the insert 54 and the force with which the ball hits the support member 30. Gravity forces the ball 52 to quickly pass through the tube it enters. However, the ribs on the interior of the tubes cause the ball to be somewhat slowed. The ball passes out one of the openings 26*a–d* that corresponds to the tube 42*a–d* into which it has entered as illustrated in FIG. 4. Once the ball exits the opening, the child picks up the ball and redeposits the same into the open end of the insert.

The curvature of the lower ends of each of the tubes can be modified in order to change the trajectory of the ball as it exits one of the associated openings. Additionally, the training device can be utilized with several balls in order to increase the speed with which the child needs to react. This is because the child will have to quickly determine which opening a ball is coming out of so he or she can pick up the ball and redeposit the sere through the open end of the insert 54 before the next ball comes out of one of the openings.

A different child can simultaneously use the training device by being positioned adjacent rear wall 16 and dropping a different ball into the same between the rear walls 58, 60 and 62 of the insert and the rear surface 73 of the dividing member 70. It should be noted that the housing can be modified so that each wall has openings formed therethrough which are connected to its own set of tubes so that three or four children can utilize the device at the same time.

In the preferred embodiment, sensors 76 and 78 are secured to the front and rear surfaces of the dividing member 70. Sensor 76 is connected to a counter 80 on the front wall 14 of the housing 12 while sensor 78 is connected to a counter 82 on the rear wall 16 of the housing in order to keep track of the number of times a ball passes through the top end 22 of the housing. The sensors can be in the form of an electric eye or lever switch. Additionally, a timer 84 is preferably secured to the front wall 14 and a timer 86 is secured to the rear wall 16 of the housing 12. The timer may include an alarm that sounds after a predetermined amount of time has passed. The sensors and timers allow a child to compete either against themselves or against each other to see who can retrieve and redeposit the most balls within a certain amount of time.

The present invention may be embodied in other specific forms without departing from the spirit or essential attributes thereof and accordingly reference should be made to the appended claims rather than to the foregoing specification as indicating the scope of the invention.

What is claimed is:

1. A training device for developing a child's motor skills comprising:

a housing having a front wall, an open top end and a bottom end, said housing further having a plurality of openings formed in said front wall adjacent said bottom end thereof;

a plurality of tube means, each of said tube means being secured in said housing and having an upper end and a lower end, said lower end of each of said tube means being associated with a different one of said openings formed in said front wall of said housing, an object adapted to pass through one of said tube means;

guide means secured to said open top end of said housing, said guide means serving to direct said object toward said open top end of said housing so that said object can randomly enter and pass through one of said tube means and out said associated opening in said front wall of said housing.

2. The training device of claim 1 further including counting means for recording the number of times said object passes through said open top end of said housing.

3. The training device of claim 1 further including alarm means for sounding an alarm after a predetermined amount of time has passed.

4. The training device of claim 1 wherein said guide means includes an insert having four walls, an open top end and an open bottom end, each of said walls converging downwardly towards said bottom end of said insert, said bottom end of said insert being secured around the periphery of said open top end of said housing.

5. The training device of claim 1 wherein said lower end of each of said tube means is curved upwardly so that said object passing through the same is projected upwardly through said associated opening in said front wall of said housing.

6. A training device for developing a child's motor skills comprising:

a housing having first and second vertical walls, an open top end and a bottom end, said housing further having a plurality of openings formed in each of said walls adjacent said bottom end thereof;

a plurality of first and second tube means, each of said tube means being secured in said housing and having an upper end and a lower end, said lower end of each of said first tube means being associated with a different one of said openings formed in said first wall of said housing, said lower end of each of said second tube means being associated with a different one of said openings formed in said second wall of said housing;

a plurality of objects adapted to pass through said tube means;

guide means secured to said open top end of said housing, said guide means serving to direct said objects toward said open top end of said housing so that said objects can randomly enter and pass through said tube means and out associated openings in said end walls of said housing, and dividing means positioned between said first and second tube means for separating the same from each other.

7. The training device of claim 6 further including counting means for recording the number of times objects pass through said open top end of said housing.

8. The training device of claim 6 further including alarm means for sounding an alarm after a predetermined amount of time has passed.

9. The training device of claim 6 wherein said guide means includes an insert having side walls, an open top end and an open bottom end, each of said walls converging downwardly towards said bottom end of said insert, said bottom end of said insert being secured around the periphery of said open top end of said housing.

10. The training device of claim 6 wherein said lower end of each of said tube means is curved upwardly so that objects passing through the same are projected upwardly through associated openings in said front wall of said housing.

* * * * *